United States Patent [19]

Kozlov et al.

[11] 4,054,395

[45] Oct. 18, 1977

[54] METHOD OF ERECTING MASS CONCRETE STRUCTURES

[76] Inventors: Alexandr Dmitrievich Kozlov, ulitsa Verkhnaya Khokhlovka, 39/47, kv. 18; Boris Alexandrovich Krylov, ulitsa Kibalchicha, 12, korpus 2, kv. 153; Alexandr Vasilievich Lagoida, ulitsa Staroslobodskaya, 14, kv. 90; Viktor Petrovich Vetrov, ulitsa Kuskovskaya, 1, kv. 69, all of Moscow; Valentin Markovich Mikhailichenko, ulitsa Lenina, 7, kv. 22, Aprelevka, Moskovskoi oblasti; Vladimir Sergeevich Isaev, naberezhnaya Fedorovskogo, 3, kv. 55, Gorky, all of U.S.S.R.

[21] Appl. No.: 697,121

[22] Filed: June 17, 1976

[51] Int. Cl.[2] ..... E02D 27/32; C04B 43/00; C08L 95/00

[52] U.S. Cl. ..... 404/79; 404/82; 404/31; 61/36 A

[58] Field of Search ..... 404/19, 31, 70, 77, 404/79, 27, 71, 72, 82; 61/36 A, 50

[56] References Cited

U.S. PATENT DOCUMENTS

| | | | |
|---|---|---|---|
| 1,573,923 | 2/1926 | Fletcher | 404/27 |
| 2,165,437 | 7/1939 | Adam | 404/31 |
| 3,577,893 | 5/1971 | Towner | 404/31 |

FOREIGN PATENT DOCUMENTS

| | | | |
|---|---|---|---|
| 916,076 | 1/1963 | United Kingdom | 404/82 |

*Primary Examiner*—John E. Murtagh
*Attorney, Agent, or Firm*—Robert E. Burns; Emmanuel J. Lobato; Bruce L. Adams

[57] ABSTRACT

A method of erecting mass concrete structures consisting in preparing a ground bed, whereupon there is laid an insulating cushion of dry concrete mix. The insulating cushion is covered with a layer of wet concrete mix. The layer is compacted and heat-treated.

2 Claims, No Drawings

METHOD OF ERECTING MASS CONCRETE STRUCTURES

BACKGROUND OF THE INVENTION

The present invention relates to concrete laying techniques, and more particularly to methods of erecting mass concrete structures.

The invention is applicable to civil engineering and can be used for the erection of different structures on frost-heaving ground and in permafrost areas.

According to the prior-art practice of erecting mass concrete structures on frost-heaving ground, the ground bed was warmed up before laying the concrete mix. In permafrost areas, concreting was preceded by preparing an insulating cushion of sand, gravel-and-sand mixture, crushed stone, and prefabricated or reinforced concrete.

In the Far North, where permafrost prevails, pile-supported structures have been increasingly common in recent years.

It must be pointed out, however, that the known techniques of erecting mass concrete structures on frost-heaving ground and in permafrost areas do not envisage the use of natural ground beds or foundations, whereby the cost of preparing such beds or foundations may be reduced to a minimum.

For example, in order to lay concrete on a frost-heaving bed, the latter must be warmed up, which is a labor- and power-consuming process. Moreover, this method does not always work, especially at low ambient temperatures and when the ground is frozen to a great depth.

Prior to laying concrete in permafrost areas, an insulating cushion has to be provided on the ground bed. The cushion consists of sand, sand-and-gravel mixture, crushed stone, and prefabricated and reinforced concrete.

Yet this type of insulation does not completely rule out the penetration of free moisture from the concrete mix through the insulating material into the ground bed. As a result, the permafrost thaws, and the supporting capacity of the ground is sharply reduced.

The known method has another disadvantage which is still more important. The method does not ensure a wholly monolithic structure, which, in turn, results in a non-uniform load distribution and strain cracking. The consequences may be disastrous.

Pile-supported structures, although highly durable, are quite costly. Besides, this technical solution does not ensure a monolithic structure which is an absolute necessity in a number of cases. There are also cases when this technique proves to be impracticable both technically and economically. A case in point is a covering extending over a great distance, for example, an airfield or road pavements.

SUMMARY OF THE INVENTION

It is the main object of the present invention to provide a method of erecting mass concrete structures which would ensure uniformity of a structure and keep intact the natural ground bed.

It is another object of the invention to reduce the amount of free mixing water in mass concrete structures.

It is still another object of the invention to provide a material for monolithic structures, possessing improved physico-mechanical properties.

It is yet another object of the invention to curb destructive processes in structures and reduce the consumption of construction materials.

The foregoing and other objects of the present invention are attained by providing a method of erecting mass concrete structures, whereby a ground bed is prepared, whereupon there are successively laid an insulating cushion and a layer of concrete mix, the layer being then compacted and heat-treated, according to which method, the material of the insulating cushion is dry concrete mix.

It is expedient that the dry concrete mix should be cooled to a subfreezing temperature, while the ambient temperature is above zero and that of the natural ground bed is below zero.

The essence of the invention is as follows. A natural ground bed is prepared, whereupon there is installed timbering and laid a layer of dry concrete mix. This is followed by laying wet concrete mix, whereafter the whole is compacted and heat-treated. The temperature of the concrete starts rising due to the outside heat and the exothermal reaction in the mix itself. The difference in the temperature of the concrete and that of the ground bed increases. The mineral hydraulic binder of the layer of dry concrete mix laid on the natural ground bed adsorbs free mixing water from the layer of the wet concrete mix. This is accompanied by a mass and heat transfer. As a result, free mixing water leaves the upper layer and enters the lower layer. The dry concrete mix gradually becomes moist and hardens. The layer of dry concrete mix rests on the ground, so its temperature is lower than that of the upper layers, due to which the hardening of the concrete in the lower layer is slow and ends when the temperature of all the layers is about the same. Thus, the physico-mechanical properties of the natural ground bed remain intact, while the form contains a uniform monolithic body of concrete with prescribed characteristics. The thickness of the dry mix layer is determined by the water-cement ratio of concrete, the volume of the structure, the maximum heat treatment temperature, the temperature of the natural ground bed and the techniques employed to prevent the latter from thawing.

The erection of monolithic concrete and reinforced concrete structures at above-zero ambient temperatures is characterized by that prior to laying dry concrete mix on a ground bed, this mix is cooled to a subzero temperature. This rules out thawing of the natural ground bed and helps to preserve its physico-mechanical properties.

It has been found that destructive processes in concrete can largely be avoided by a proper heat treatment of the concrete mix.

The concrete mix should be heat-treated prior to being compacted which is done by placing a layer of preheated wet concrete mix. Any known warming technique can be used for the purpose.

However, the present invention does not exclude the conventional type of heat treatment because this, too, helps to curb destructive processes.

Thus, the proposed method of erecting mass concrete structures is more advantageous both technologically and economically than any conventional method of erecting monolithic structures of concrete and reinforced concrete. The proposed method is easy to put into practice. It requires no special equipment and makes it possible to erect high-quality mass concrete structures in severe climatic conditions. Construction time and costs are reduced.

The proposed method is illustrated by the following examples.

EXAMPLE 1

This is an example of implementing the proposed method of erecting monolithic concrete and reinforced concrete structures when the temperature of the natural ground bed is above zero. Concrete floors were to be made of concrete with M = 300 kgf/cm$^2$. The concrete layer was to be 22 cm thick. The temperature of the natural ground bed was +7° C, and the ambient temperature was +15° to +18° C.

The natural ground bed was levelled, forms were assembled, and a layer of dry concrete mix was laid.

The layer was 8 cm thick, its temperature being about the same as the ambient temperature, i.e. +15° to +18° C.

The dry concrete layer was flattened, and on it there was laid a layer of conventional wet concrete mix which was then subjected to intensified heat treatment so that its temperature was raised to +70° C during 2 to 3 minutes. The heat source was then switched off, and the surface of the compacted concrete was covered with a steam- and heat-insulating material.

On the second day, the concrete was found to have the following physico-mechanical characteristics:

compression strength, 85% of that of the concrete grade;

bending-tensile strength, 95% of that of the concrete grade.

Subsequent comparison of the characteristics of this concrete to those of concrete hardened in normal conditions (control samples) showed a 25% increase in compression strength and a 35% increase in bending-tensile strength. Frost resistance rose by 75 cycles.

In addition, power consumption was reduced twofold, as compared to conventional concrete laying techniques.

EXAMPLE 2

This is an example of implementing the proposed method of erecting mass concrete structures at subzero temperatures of the natural ground bed and subzero ambient temperatures.

Concrete floors were to be made of concrete with M = 300 kgf/cm$^2$. The floor thickness was 22 cm. The temperature of the natural ground bed was −4° C, and the ambient temperature was between −12° and −14° C.

A natural ground bed was prepared, whereupon there were installed forms and laid a layer of dry concrete mix.

The dry concrete mix layer was 12 cm thick, and its temperature was −9° C.

The dry and wet concrete mix layers were laid as in Example 1.

After drying a layer of wet concrete mix, it was subjected to intensified heat treatment, so that its temperature reached +70° C during 2 to 3 minutes. The concrete surface was then covered with a steam- and heat-insulating material.

After 3 days, the concrete had the following characteristics:

compression strength, 75 to 80% of that of the concrete grade;

bending-tensile strength, 85 to 90% of that of the concrete grade.

After 5 to 7 days, the strength characteristics of the concrete corresponded to those of the given grade.

In order to evaluate the physico-mechanical properties of concrete laid according to the proposed method, concrete samples taken from the structure were allowed to harden in normal conditions for 28 days.

Comparison with control samples showed an increase of more than 20% in compression strength and of more than 30% in bending-tensile strength. Frost resistance rose by 70 cycles.

Power consumption was two and a half times less, as compared to conventional concrete laying techniques.

EXAMPLE 3

When erecting mass concrete structures on frost-heaving ground or in permafrost conditions, and when the temperature of the natural ground bed is below zero, whereas the ambient temperature is above zero, it is a sine qua non condition that prior to being laid on the ground bed, the dry concrete mix should be cooled to a subzero temperature.

The concrete laying procedure was as that of Example 2.

At a temperature of the natural ground bed of −4° C and at an ambient temperature of +12° C, the technical characteristics of the concrete and the economic efficiency of the method were somewhat higher than those of Example 2, which is another proof of the effectiveness of the novel method.

It is clear from the foregoing examples that the proposed method is more effective both technologically and economically than the conventional techniques.

Apart from that, the proposed method is simple and requires no special equipment.

In a number of cases, the method of the present invention makes it possible to dispense with costly pile supports. When laying cement and concrete pavements for roads and air fields in permafrost areas, the proposed method makes it possible to use the ground as the natural bed for the pavement, while preserving the physico-mechanical properties of this bed.

With the use of the proposed method, concreting can be carried out all the year round.

What is claimed is:

1. A method for erecting mass concrete structures comprising, preparing a ground bed of frost-heaving or permafrost ground and covering it with an insulating cushion of dry concrete mix, laying on said cushion wet concrete mix, and compacting said wet concrete mix and heat-treating it.

2. A method as claimed in claim 1, wherein the material of the insulating cushion of said dry concrete mix, prior to its being laid on a ground bed of frost-heaving or permafrost ground, is cooled to a subzero temperature if the ambient temperature is above zero.

* * * * *